US005829104A

United States Patent [19]

Gay et al.

[11] Patent Number: 5,829,104

[45] Date of Patent: Nov. 3, 1998

[54] STRAP CLASP

[75] Inventors: Jacques Hubert Gay, Chougny; Luigi Ferrario, Hauterive, both of Switzerland

[73] Assignee: Gay Freres Vente et Exportation S.A., Geneva, Switzerland

[21] Appl. No.: 930,821

[22] PCT Filed: Nov. 27, 1996

[86] PCT No.: PCT/CH96/00417

§ 371 Date: Feb. 27, 1997

§ 102(e) Date: Feb. 27, 1997

[87] PCT Pub. No.: WO97/29660

PCT Pub. Date: Aug. 21, 1997

[51] Int. Cl.[6] ..... A44C 5/00

[52] U.S. Cl. ..... 24/71 J; 24/68 J; 24/265 WS

[58] Field of Search ..... 24/71 J, 70 J, 24/69 J, 68 J, 265 WS

[56] References Cited

U.S. PATENT DOCUMENTS

| | | | |
|---|---|---|---|
| 1,741,421 | 12/1929 | Kraemer | 24/71 J |
| 1,997,723 | 4/1935 | Franklin, Jr. | 24/71 J |
| 2,532,840 | 12/1950 | Gaun | 24/71 J |
| 4,382,318 | 5/1983 | Takimoto | 24/71 J |

FOREIGN PATENT DOCUMENTS

| | | |
|---|---|---|
| 0607726A1 | 7/1994 | European Pat. Off. . |
| 0648444A1 | 4/1995 | European Pat. Off. . |
| 661186A5 | 7/1987 | Switzerland . |
| 2278148 | 11/1994 | United Kingdom . |

*Primary Examiner*—Victor N. Sakran
*Attorney, Agent, or Firm*—Oppedahl & Larson

[57] ABSTRACT

The invention relates to a clasp (1) for a band or bracelet (2) having two strips (6, 8) articulated with respect to one another by one of their ends across a common hinge (10), having a cover (3) and a base (9) detachably arranged around a common rod (11), which is guided by a transverse branch (6.4) firmly fixed to the first strip (6), having a first bracelet strand (2.1) fixed to the second strip (8), having a tongue (4) mounted on the base (9) permitting the fixing of a second bracelet strand (2.2), a reinforcement of said fixing taking place by lowering the cover (3) onto the tongue (4) and the lowered cover (3) and base (9) are jointly articulated with respect to the first strip (6), making it possible to open the clasp (1) in order to remove the bracelet (2) without undoing the fixture.

16 Claims, 3 Drawing Sheets

STRAP CLASP

Figure 1A:
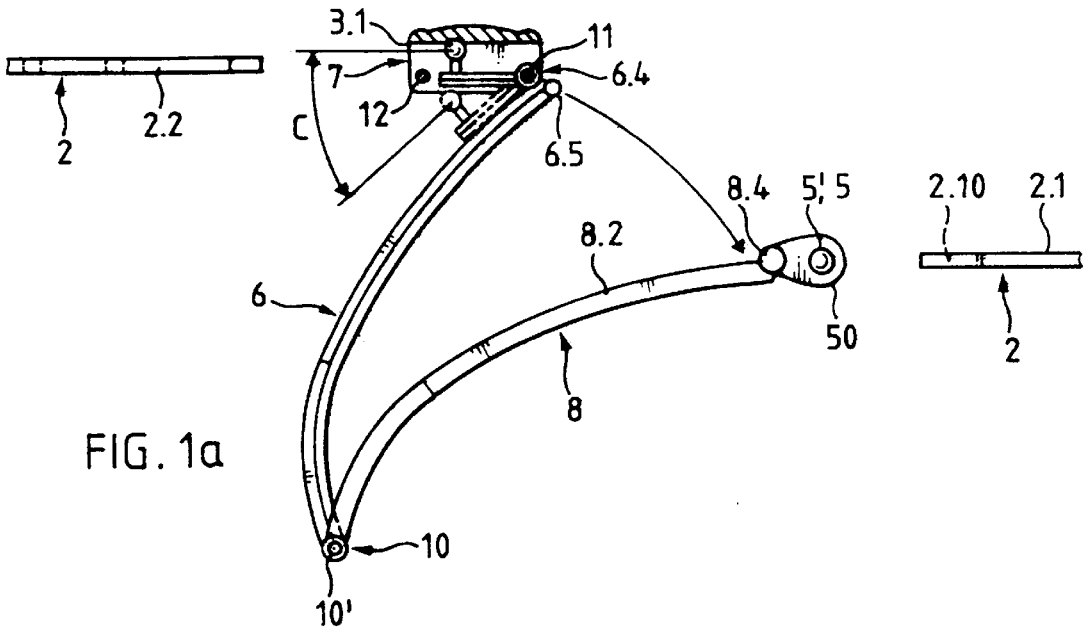

This application claims priority from PCT application number PCT/CH96/00417 designating the United States, which application is hereby incorporated by reference.

The invention relates to fasteners and more particularly a fastener having a clasp for a bracelet according to the claims.

Fasteners are used in numerous different technical fields. They are e.g. used in security engineering (doors, windows, etc.) and in watch and clock making (wrist-watches). For example, wrist-watch bracelets or bands open and close by means of known fastening means such as an opening out and snap-on clasp.

Such a bracelet clasp is conventionally provided with a bar or pin and a stud for fixing strands of the bracelet and is equipped with opening out strips so as to be able to remove the wrist-watch with the bracelet closed. Said bar permits a permanent fixing of a first strand of the bracelet to the clasp and said lug permits the temporary fixing of another strand of the bracelet to the clasp by introducing the stud into a hole in the said free strand. The bar and the stud are attached to different strips, articulated with respect to one another through a common hinge, permitting an increase in the diameter of the bracelet on separating and pivoting the two strips so as to be able to remove the bracelet without undoing the temporary fixing of the strand.

Hereinafter, discussion will be limited to the advantages and disadvantages of a wrist-watch fastener having an opening out and snap-on clasp. A description will be given of disadvantages associated with a stable fixing of the free strand to the stud of a clasp strip, a strong construction of the elements of the clasp and a random length regulation of the bracelet in a reliable and easy manner.

The fixing of the free strand is not very reliable when the stud used is articulated with respect to a support strip and when said mechanism has modest dimensions so as to be deformable and damageable under the effect of the torque and tensile forces intercepted by the bracelet. The opening of the clasp and the regulation of the length of the bracelet take place in several stages and require a large number of elements on the one hand for carrying out the unlocking of the strips of the clasp and on the other for undoing the fixing of the free strand of the bracelet.

A solution permitting an easy fixing of the free strand of the bracelet is described in Swiss patent 661,186 by incorporating a stud into a solid cover articulated with respect to a first support strip permitting the fixing of a free strand by pivoting the cover towards said support strip and introducing the stud into a hole in said strand. The locking of the clasp strips is obtained by notching a second stud placed on the first support strip in an opening of a second clasp strip.

This construction suffers from the disadvantage that the torque and tensile forces acting on the bracelet are intercepted by the hinge of the cover, so that it can become deformed and damaged, leading to rapid wear.

A solution making it possible to remove the bracelet without any risk of undoing the fixing of the free bracelet strand is described in European patent 607,726 with a stud located on a base plate detachably connected to a first strip, permitting the fixing of the free bracelet strand. A cover is mounted on said first strip and articulated with respect to said strip and with respect to said base plate, permitting a pivoting towards the base plate and a notching with said base plate. Another bracelet strand is permanently fixed to a second strip of the clasp. The locking of the two strips is obtained by engaging two openings of two strips on two rods mounted on a third clasp strip.

This construction suffers from the disadvantage that the torque and tensile forces acting on the bracelet are intercepted by the hinge of the cover and the base plate, so as to be able to deform and damage it, leading to rapid wear.

Therefore the object of the present invention is to provide a solution to these problems by creating a fastener having a clasp and with general applications, e.g. for a wrist-watch, which has a particularly compact construction requiring a minimum number of elements for locking the clasp and regulating the length of the bracelet or band, whilst still being compatible with known, proven manufacturing methods.

This object is achieved by the invention as defined in the claims.

The clasp according to the invention is the result of a detailed study of mechanisms governing the fixing of bracelet strands and the locking of clasp strips. The invention more particularly relates to the torque and tensile forces intercepted by said bracelet or band. Said forces are directed towards strong, stable elements avoiding any deformation and damage to the sensitive elements of the clasp, particularly means for locking the clasp and the cover hinge.

The clasp comprises two strips articulated within one another by one of their ends, so that the two strips can be turned down or lowered in one another. It is possible to carry out a first locking of the strips by notching a pin of the inner strip to a transverse branch of the outer strip.

A bar mounted on the outer strip permits the permanent fixing of a first strand of the bracelet to the clasp. A tongue mounted on a base permits the fixing of another strand or free strand of the bracelet.

The base is mounted in a detachable manner about a rod with respect to the inner strip. Said rod is installed within a transverse branch of the inner strip. The transverse branch has several aligned half-bushings having a guidance function for keeping the rod along their axis. At least two half-bushings are spaced from one another, resulting in a small flapping or stroke angle of the rod and serving as a robust, stable pendant for intercepting the torque and tensile forces acting from the bracelet through the tongue to the base and from the base to the transverse branch and from the transverse branch to the robust strip, thus preventing the deformation and damage to the more sensitive elements of the clasp.

The cover is mounted in detachable manner about the rod relative to the inner strip so as to permit a reinforcement of the fixing of the free strand to the tongue. Advantageously a central portion of the cover is lowered or turned down on the tongue.

The cover makes it possible to carry out a second locking of the lowered strips of the clasp. It is advantageously possible for the lateral arms of the cover and lateral branches of the outer strip to close by notching.

The cover and base have no direct connection, avoiding any propagation of torque and tensile forces intercepted by the base towards the cover and which could lead to the deformation and damage to the hinge of the cover.

The cover and base of the tongue are jointly articulated with respect to the inner strip and are individually articulated with respect to one another. The said joint articulation of the cover and base takes place by means of a frictional force of the bracelet connecting the cover and the base through the bracelet.

Thus, using the clasp according to the invention, it is possible to pivot the cover and the base carrying the tongue jointly with respect to the strips, removing the second locking and giving access to the unlocking of the strips. The fixing of the free strand by the tongue remains reinforced by the cover and is not affected by said joint pivoting, permitting the unlocking of the strips so as to remove the bracelet without any risk of it becoming undone. It is also possible to individually pivot the cover relative to the base carrying the tongue in order to remove said reinforcement of the fixing of the free strand and give access to the tongue. The release of the free strand of the bracelet fixed by the tongue takes place in a separate stage, permitting a length regulation of the bracelet in an easy, rapid manner on separating the free strand from the tongue. It is in particular possible to regulate the length of the bracelet without removing the bracelet from the arm.

The invention is described in greater detail hereinafter relative to the attached drawings, wherein show:

FIGS. 1*a,* 1*b* & 1*c* A diagrammatic view showing a preferred embodiment of a clasp according to the invention.

Figure 2:
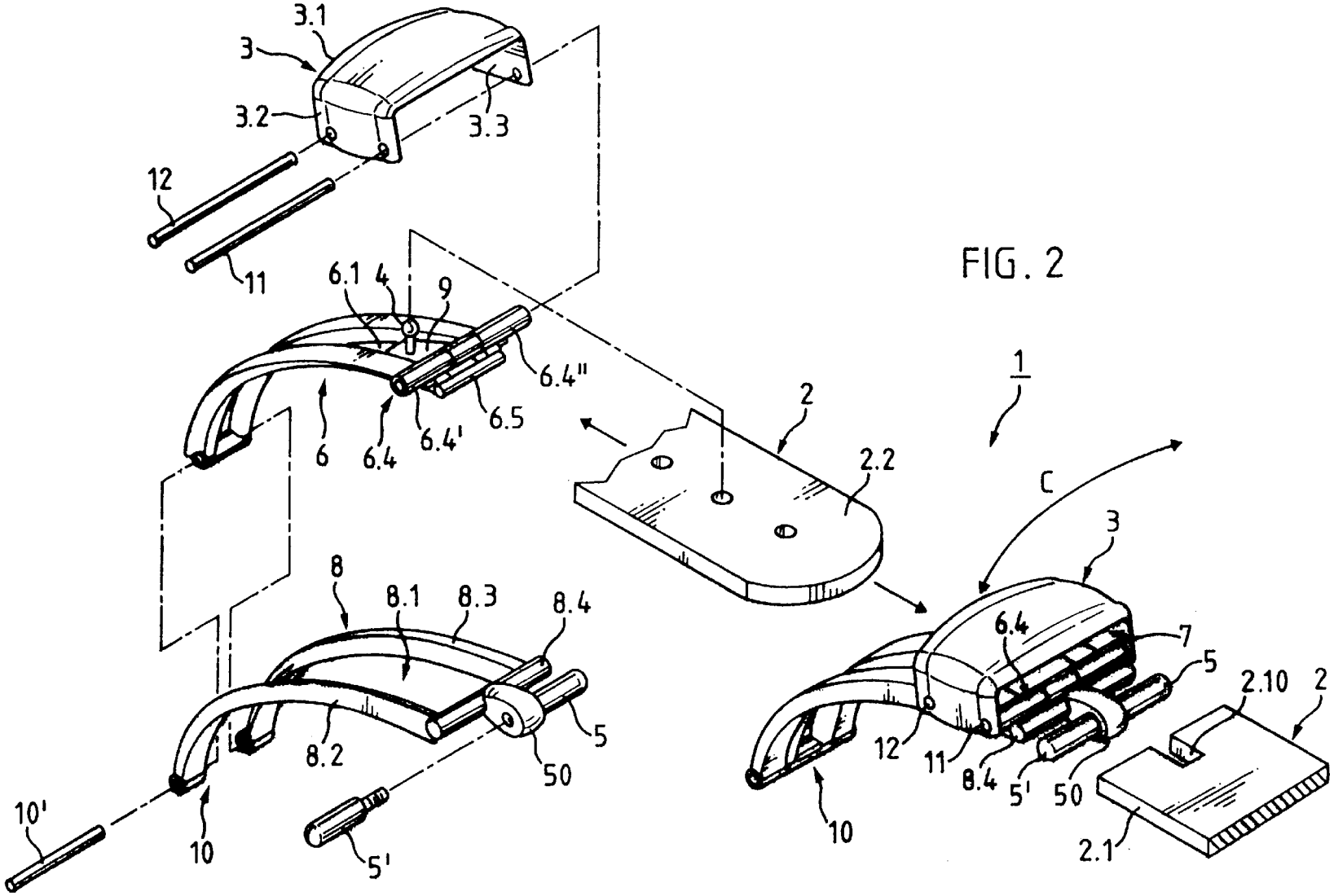

FIG. 2 A perspective, exploded view of said preferred embodiment of a clasp according to FIGS. 1*a,* 1*b* and 1*c.*

Figure 3:
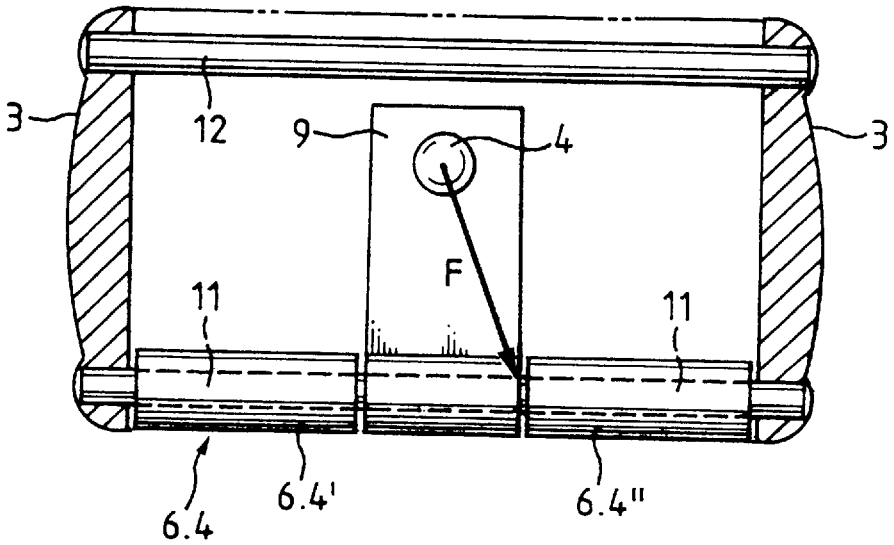

FIG. 3 A diagrammatic view of the preferred embodiment of a clasp according to FIGS. 1*a,* 1*b,* 1*c* and 2, showing how the torque and tensile forces are intercepted.

FIGS. 1*a,* 1*b* and 1*c* are a diagrammatic view showing the fixing of strands of a bracelet or band to a preferred embodiment of a clasp according to the invention, together with the locking mechanism of the strips of said clasp and the reinforcement mechanism of said fixing and two possible locking means. FIG. 2 is a perspective, exploded view of said preferred embodiment of a clasp according to FIGS. 1*a,* 1*b* and 1*c.*

The clasp 1 comprises two strips 6, 8 articulated with respect to one another by one of their ends through a common hinge 10, so as to be able to pivot. According to FIG. 2, said ends of the two strips 6, 8 have aligned holes serving as a guide bushing in order to maintain along their axis a rod 10' of the hinge 10. The bracelet and visible elements of the fastener of the clasp are preferably made from metal, e.g. stainless steel and/or gold.

A first or inner strip 6 is located within a second or outer strip 8. The outer strip 8 has a notch 8.1 with a shape and dimensions corresponding to those of the inner strip 6, so that the latter is partly or wholly included in said notch 8.1, when the clasp is in the closed position. The two longitudinal branches 8.2, 8.3 of the outer strip 8 have bearing surfaces 8.20, 8.30 for supporting the corresponding surfaces of the inner strip 6 during the closing of the clasp. It is possible to bring about a first locking of the strips by notching a pin 6.5 of the inner strip 6 to a transverse branch 8.4 of the outer strip 8. As the two strips 6, 8 directly intercept the torque and tensile forces acting on the bracelet 2, said reciprocal engagement in one another of the two strips 6, 8 leads to a clasp 1 closed in a particularly reliable manner as a result of its stability and rigidity.

A bar 5, 5' mounted on the outer strip 8 permits the permanent fixing of a first strand 2.1 of the bracelet 2 to the clasp 1. It is formed by two detachable, lateral portions 5, 5', which can e.g. be separately screwed into tapped holes of a central portion 50, firmly attached to a transverse branch 8.4 of the outer strip 8. Said bar 5, 5' permits a particularly easy and rapid fitting of the first bracelet strand 2.1 by fixing said first strand 2.1 with the aid of a slot 2.10 to the central portion 50 and by screwing the two lateral portions 5, 5' through said first strand 2.1 in tapped holes of a central portion 50. With the knowledge of the present invention the expert can implement other bar constructions using other means and methods for connecting the lateral and central portions and the first strand to a strip of the clasp.

The tongue 4 mounted on the inner strip 6 permits the fixing of another free strand 2.2 of the bracelet 2. It is fitted to a base 9 attached to the transverse branch 6.4 of the inner strip 6. The tongue 4 and base 9 are fixed, preferably by welding, screwing or even milling in one piece. The transverse branch 6.4 and inner strip 6 are fixed, preferably by welding. Other connection methods are obviously possible. With the knowledge of the present invention, the expert can implement other fixing means for other base materials, e.g. heat fusion for heat-fusible, synthetic materials, etc.

The bar 5, 5' and tongue 4 are fitted on the other ends of the two strips 6, 8, i.e. on the side opposite to the hinge 10. The bar 5, 5' and tongue 4 are fixed to the two strips 6, 8 through a central portion 50 and a base 9. These portions 50, 9 intercept the torque and tensile forces exerted on the bracelet 2 and acting through the strands 2.1, 2.2 of said bracelet 2 on the bar 5, 5' and tongue 4 of the clasp 1. These portions 50, 9 have a solid construction with a certain thickness and rigidity.

The cover 3 and base 9 of the tongue 4 are pivotably mounted and attached to the same transverse branch 6.4 of the inner strip 6. A rod 11 is installed within the transverse branch 6.4 of the inner strip 6. Preferably, the transverse branch 6.4 has at least two half-bushings 6.4', 6.4", which are aligned with one another and serving as a guide bushing in order to maintain said rod 11 along their axis. The two half-bushings 6.4', 6.4" are spaced from one another, so that it is possible to reduce the stroke clearance of the rod 11. Thus, the half-bushings 6.4', 6.4" serve as a pendant for the rod 11 of the base 9, which makes it possible to intercept the torque and tensile forces exerted by the bracelet strand 2.2 on the tongue 4 and then from the base 9 on rod 11 without deforming and damaging other more sensitive elements of the clasp 1. This protection of the sensitive elements more particularly relates to the locking means of the clasp and the hinge of the cover 3. For this purpose, the at least two half-bushings 6.4', 6.4" are arranged so as to prevent any propagation of forces intercepted by the base 9 towards the cover 3. The base 9 is attached to a central portion of the rod 11 and is arranged so as to be located between the two half-bushings 6.4', 6.4" enabling the base 9 to transmit the intercepted forces to the rod 11 whilst producing a minimum moment. The cover 3 is attached across two lateral arms 3.2, 3.3 to the ends of the rod 11, the cover 3 and base 9 being separated by the two half-bushings 6.4', 6.4" enabling the base 9 to transmit the intercepted forces to the rod 11, whilst avoiding any deterioration of the cover 3. The resilience (deformation) curve of the rod 11 is limited in such a way by the two half-bushings 6.4', 6.4", that there is no danger of deformation and damage. The construction according to the invention is shown in detail in FIG. 3. Any torque and tensile force F acting on the rod 11 is intercepted by the half-bushings 6.4', 6.4", so that no components of said forces act across the rod 11 on the cover 3. Unlike in the case of the clasp described in European patent 607,726, the rod rests in two half-bushings, which are spaced from one another and serve as a stable guide bushing. The transmission of torque and tensile forces intercepted by the tongue through the rod to the cover is impossible, the cover being separated from the lines of forces intercepted by the bracelet. According to European patent 607,726, said forces intercepted by the bracelet act on the rod and under the effect of the resilience curve of said rod act directly on the relatively sensitive hinge of the cover.

The cover 3 and base 9 are not directly linked. As the base 9 is located within the cover 3 and within a notch 6.1 of the inner strip 6, it is fitted between the two half-bushings 6.4', 6.4". The two half-bushings 6.4', 6.4" are located on the edges of the inner strip 6. The base 9 is attached to a central portion of the rod 11 and between the two half-bushings 6.4', 6.4", permitting pivoting by a random angle C. The cover 3 is installed outside the two half-bushings 6.4', 6.4". The cover 3 is attached across two lateral arms 3.2, 3.3 to the ends of said rod 11, permitting a pivoting by an angle C. Unlike in the case of the clasp described in European patent 607,726, where the cover and base plate are connected by notching, the cover has no direct, fixed connection to the base, separating the cover from the lines of forces intercepted by the bracelet, so that said torque and tensile forces cannot damage the hinge of the cover.

Advantageously, the cover 3 and base 9 can carry out a joint pivoting under the effect of a frictional force transmitted by the bracelet 2. During such a joint pivoting, the cover 3 and base 9 do not change their reciprocal position, permitting the opening and closing of the bracelet 2 without any risk of undoing the fixing of the free strand 2.2 by the tongue 5. Within the scope of the present invention, numerous variants of such a joint pivoting are possible. For example, as the free strand 2.2 has a certain rigidity and is fixed by the tongue 5, it exerts a slight frictional force on the inner walls of the cover 3. A similar frictional force can be produced by pressing the cover 3 against the free strand 2.2 during the opening of the cover. Unlike in the case of the clasp described in European patent 607,726, joint pivoting is performed without requiring a direct connection between a cover and a base plate. Said clasp comprises a cover and a base fixed by notching. Such a fixed connection by notching the cover with the base represents a complication requiring additional elements. The solution according to the invention fulfills the same function and simplifies the design and construction of the clasp. With the knowledge of the present invention, the expert can implement other variants of such a joint pivoting, using other means and procedures.

The cover 3 is able to control, i.e. release or prevent access to the tongue 4 by pivoting with respect to the base 9. The cover 3 is also able to control, i.e. release or prevent the unlocking of the strips 6, 8 by pivoting with respect to the closed strips 6, 8. Advantageously, the cover 3 and base 9 pivot jointly in order to effect a second unlocking and/or for freeing access on first unlocking the strips 6, 8.

In order to open the closed clasp, it is merely necessary to e.g. place a nail on the nail groove 3.1 and lift the cover 3. Advantageously, the cover 3 and base 9 perform a joint pivoting. Under the effect of an opening force, the cover 3 is raised and the elastic, lateral arms 3.2, 3.3 of the cover 3 reassume their initial structure and lose the slight deformation during the engagement on the outer strip 8.

In order to separate the cover 3 from the base 9, it is merely necessary to continue the pivoting by a random angle C. It is e.g. possible to limit the pivoting of the base 9 to a smaller angle compared with the cover 3. This separation angle can be fixed at 30° or 40°.

Figure 1B:
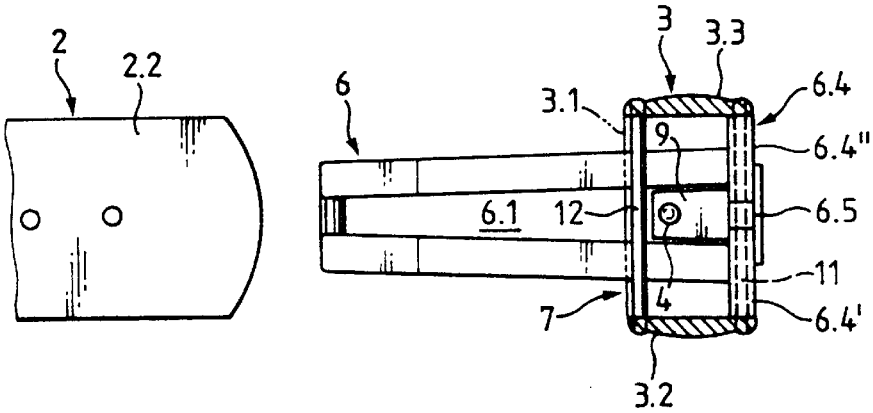
Figure 1C:
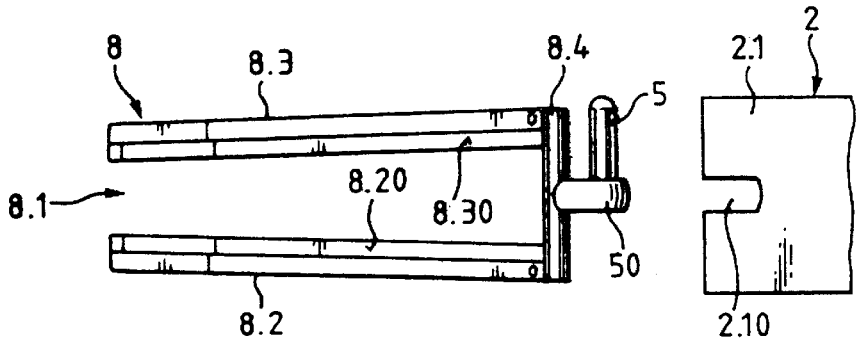

It is consequently possible to regulate the length of the bracelet 2. With reference to FIGS. 1*a*, 1*b* and 2 showing a clasp 1 with a raised cover 3 separated from the base 9, the second bracelet strand 2.2 can be inserted in a space 7 defined on one side by two rods 11, 12 of the cover 3, respectively by a transverse branch 6.4 of the first strip 6, and on the other side by a central portion of said cover 3. Said second, inserted bracelet strand 2.2 is guided by the two rods 11, 12 in the space 7 permitting a controlled fixing and a random adjustment of the length of the free strand 2.2 by positive engagement of said free strand 2.2 with the tongue 4. Preferably, the second bracelet strand 2.2 is fixed by the insertion of the tongue 4 in one of the holes of the free strand 2.2, thus preventing a longitudinal movement of the bracelet 2. The tongue 4 has a cambered end so as to be able to maintain the free strand 2.2 by friction. Advantageously, a central portion of the cover 3 can rest on said cambered end of the tongue 4.

In order to again close the open clasp 1, it is sufficient to lower the cover 3 onto the tongue 4 and push the cover 3 and base 9 in the direction of the two strips 6, 8 until one or both notching systems engage. It is possible to perform a first locking of the strips by the notching of a pin 6.5 of the inner strip 6 to a transverse branch 8.4 of the outer strip 8.

It is possible to perform a second locking of the strips 6, 8 by notching lateral arms 3.2, 3.3 of cover 3 with outer portions of the two longitudinal branches 8.2, 8.3 of the outer strip 8. Under the effect of a locking force, the lateral arms 3.2, 3.3 of the cover 3 are pushed onto the longitudinal branches 8.2, 8.3 of the outer strip 8. The lateral branches 3.2, 3.3 have a certain elasticity. The reciprocal spacing of the two longitudinal branches 8.2, 8.3 is chosen in such a way that the lateral branches 3.2, 3.3 are slightly deformed during engagement.

It is obvious that the first locking performed by the pin 6.5 of the inner strip 6 and the transverse branch of the outer strip 8 and the second locking performed by the cover 3 of the inner strip 6 and the longitudinal branches 8.2, 8.3 of the outer strip 8 are optional. With the knowledge of the present invention, the expert can implement variants of a clasp according to the invention closing either solely by said first locking or solely by said second locking, or by a combination of the first and second locking.

We claim:

1. Clasp (1) for bracelet (2), comprising a first and a second strips (6, 8) articulated with respect to one another making it possible to increase the diameter of the bracelet (2) in order to remove it, a first bracelet strand (2.1) fixed to a second strip (8) and a second, free bracelet strand (2.2), characterized in that a tongue (4) forming part of a base (9) permits a fixing of the second bracelet strand (2.2) by positive engagement with the tongue, that the base (9) is detachable about a rod (11) and that a transverse branch (6.4) is firmly fixed to the first strip (6) having at least two half-bushings (6.4', 6.4") serving as a guide for the rod (11), making it possible to intercept the torque and tensile forces exerted by the second bracelet strand (2.2) on the tongue (4), from base (9) on rod (11) and from rod (11) on the first strip (6) without deforming and damaging other more sensitive elements of the clasp (1).

2. Clasp (1) according to claim 1, characterized in that the base (9) is attached to a central portion of the rod (11) and between two half-bushings (6.4', 6.4") enabling the branch (9) to transmit the intercepted forces to the rod (11) without deforming and damaging the latter.

3. Clasp (1) according to claim 1, characterized in that a cover (3) is attached across the two lateral arms (3.2, 3.3) to the ends of the rod (11), that the base (9) is attached to a central portion of the rod (11) and that the cover (3) and base (9) are separated by two half-bushings (6.4', 6.4"), enabling the base (9) to transmit the intercepted forces to the rod (11) and prevent them affecting the cover (3).

4. Clasp (1) according to claim 3, characterized in that the lowered cover (3) and base (9) are interconnected under the effect of a frictional force across the bracelet strand (2.2), permitting their joint articulation with respect to the first strip (6) and the opening of the clasp (1) in order to remove the bracelet (2) without undoing the fixture.

5. Clasp (1) according to claim 3, characterized in that the second bracelet strand (2.2) can be inserted in a space (7)

defined by two rods (11, 12) of the cover (3) and by the transverse branch (6.4) and that said second, inserted bracelet strand (2.2) is guided in the space (7) permitting a controlled fixing of the second bracelet strand (2.2) by the tongue (4).

6. Clasp (1) according to claim 1, characterized in that a cover (3) is detachable about the rod (11), permitting the reinforcement of the fixing of the second bracelet strand (2.2) by positive engagement with the tongue on lowering onto said tongue (4).

7. Clasp (1) according to claim 6, characterized in that the tongue (4) has a cambered end so as to be able to hold the free strand (2.2) by friction and that a central portion of the cover (3) rests on said cambered end of the tongue (4).

8. Clasp (1) according to claim 1, characterized in that a pin (6.5) is placed on the first strip (6) and a transverse branch (8.4) is placed on the second strip (8), permitting a first locking of the strips (6, 8) by notching bending the first strip (6) onto the second strip (8).

9. Clasp (1) according to claim 8, characterized in that it is closed by the first locking and/or by the second locking.

10. Clasp (1) according to claim 1, characterized in that the first strip (6) is fitted within the second strip (8) as a notch (8.1) with a shape and dimensions corresponding to those of the first strip (6), so that the latter is wholly or partly included in said notch (8.1) when the clasp (1) is in the closed position.

11. Clasp (1) according to claim 1, characterized in that the second strip (8) has two longitudinal branches (8.2, 8.3) with bearing surfaces (8.20, 8.30) for supporting the corresponding surfaces of the inner strip (6) during the closing of the clasp, rendering the latter rigid and stable.

12. Clasp (1) according to claim 1, characterized in that a bar (5, 5') is mounted on a central portion (50) firmly fixed to one end of the second strip (8), anchoring the first bracelet strand (2.1) to the second strip (8), so that the torque and tensile forces intercepted by the bracelet (2) act across the bar (5, 5') on the central portion (5) and on the second strip (8).

13. Clasp (1) according to claim 12, characterized in that the bar (5, 5') comprises two detachable, lateral portions (5, 5'), which can be separately screwed into tapped holes of the central portion (50), firmly attached to a transverse branch (8.4) of the second strip (8), permitting a particularly easy and rapid fitting of the first bracelet strand (2.1) by fixing it with the aid of a slot (2.10) to the central portion (50) and by screwing the two lateral portions (5, 5') across said first strand (2.1) in tapped holes of a central portion (50).

14. Clasp (1) according to claim 1, characterized in that the cover (3) has lateral arms (3.2, 3.3), permitting a second locking of the strips (6, 8) by notching lateral arms (3.2, 3.3) with outer portions of two longitudinal branches (8.2, 8.3) of the outer strip (8).

15. Clasp (1) according to claim 14, characterized in that the lateral arms (3.2, 3.3) have a certain elasticity and the reciprocal spacing of the two longitudinal branches (8.2, 8.3) is chosen in such a way that the lateral arms (3.2, 3.3) are slightly defined during the engagement of the cover (3) on the outer strip (8).

16. Clasp (1) according to claim 14, characterized in that it is closed by the first locking and/or by the second locking.

* * * * *